US011391130B2

(12) United States Patent
Anderson et al.

(10) Patent No.: US 11,391,130 B2
(45) Date of Patent: Jul. 19, 2022

(54) GAS-LIFT SYSTEM

(71) Applicant: INNOVEX DOWNHOLE SOLUTIONS, INC., Houston, TX (US)

(72) Inventors: Adam Anderson, Houston, TX (US); Sam Wildman, Jr., Houston, TX (US); Carlos Isaac Venegas, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 52 days.

(21) Appl. No.: 17/107,089

(22) Filed: Nov. 30, 2020

(65) Prior Publication Data

US 2021/0189850 A1 Jun. 24, 2021

Related U.S. Application Data

(63) Continuation-in-part of application No. 16/884,763, filed on May 27, 2020, now Pat. No. 10,851,628.

(60) Provisional application No. 62/950,526, filed on Dec. 19, 2019, provisional application No. 63/084,608, filed on Sep. 29, 2020, provisional application No. 63/050,192, filed on Jul. 10, 2020.

(51) Int. Cl.
*E21B 43/12* (2006.01)
*E21B 34/10* (2006.01)

(52) U.S. Cl.
CPC ..... *E21B 43/123* (2013.01); *E21B 34/106* (2013.01)

(58) Field of Classification Search
CPC ..... E21B 34/10; E21B 34/106; E21B 34/16; E21B 43/123
See application file for complete search history.

(56) References Cited

U.S. PATENT DOCUMENTS

| | | | |
|---|---|---|---|
| 4,295,795 | A | 10/1981 | Gass et al. |
| 2015/0107848 | A1 | 4/2015 | Leitch |
| 2019/0145220 | A1 | 5/2019 | Patel et al. |

OTHER PUBLICATIONS

Anderson et al., "Gas Lift System," U.S. Appl. No. 16/884,763, filed May 27, 2020, 25 pages.

*Primary Examiner* — Kristyn A Hall
(74) *Attorney, Agent, or Firm* — MH2 Technology Law Group LLP

(57) ABSTRACT

A gas-lift system and method, of which the gas-lift system includes a first valve configured to be coupled to a production tubing, a second valve configured to be coupled to the production tubing at a position that is subjacent to the first valve, and a control line coupled to the first valve and the second valve, and configured to apply a control line pressure to the first and second valves, the control line pressure applied by the control line being independent of an annulus pressure in the annulus and a production tubing pressure in the production tubing. The first valve is configured to actuate at least partially in response to the control line pressure, and the second valve is configured to actuate at least partially in response to the control line pressure.

20 Claims, 8 Drawing Sheets

GAS-LIFT SYSTEM

CROSS-REFERENCE TO RELATED APPLICATIONS

This application is a continuation-in-part of U.S. patent application Ser. No. 16/884,763, which was filed on May 27, 2020 and claims priority to U.S. Provisional Patent Application No. 62/950,526, which was filed on Dec. 19, 2019. This application also claims priority to U.S. Provisional Patent Application No. 63/084,608, which was filed on Sep. 29, 2020, and to U.S. Provisional Patent Application 63/050,192 filed on Jul. 10, 2020. Each of these priority applications is incorporated by reference in its entirety here.

BACKGROUND

In oil and gas wells, hydrostatic pressure of fluid in the well may be too high to allow for unassisted production of fluids from within the formation. Gas lift, sometimes referred to as "artificial lift," may thus be employed to alleviate the hydrostatic pressure above the lower area of the well and thereby allow hydrocarbons to be recovered therefrom.

To this end, a production tubing with a gas-lift valve placed proximal to the bottom of the production tubing may be deployed into the well. The valve may be open, and fluid may initially fill the annulus between the well and the production tubing, as well as the inside of the production tubing. Gas may then be supplied into the annulus at pressure, which may drive the gas-liquid interface in the annulus downward, below the level of the gas-lift valve. The gas may then flow into the production tubing through the open gas-lift valve and may partially fill the production tubing. This may reduce the hydrostatic pressure at the bottom of the production tubing, thereby allowing the pressure of the fluid in the reservoir to draw the hydrocarbons through the production tubing and to the surface.

In some cases, multiple gas-lift valves may be used at different positions along the length of the production tubing. The function may be similar to the single-valve system discussed above. The gas-lift valves may initially all be open, e.g., as the hydrostatic pressure provided by the column of fluid in the annulus may be above a closing pressure of the gas-lift valves. Gas may be injected into the annulus, pushing the column of fluid downward until the shallowest valve is in communication with the gas. The gas may then proceed through the shallowest valve, as explained above. Gas may, however, continue to be injected, further driving the gas-liquid interface downward in the annulus, until the gas reaches the next-shallowest valve. When this occurs, the gas may begin flowing into the production tubing via the second valve. Further, the gas pressure in the annulus at the shallowest valve may drop below the closing pressure of the first valve, resulting in the first valve shutting. This process may repeat for each subjacent valve.

However, gas-lift valve systems generally use the injection pressure in the annulus to actuate the valves. This can potentially limit the number of valves that can be used while still staying within practical injection pressure constraints.

SUMMARY

Embodiments of the disclosure include a gas-lift system including a first valve configured to be coupled to a production tubing. The first valve is configured to provide selective communication of a wellbore fluid between an interior of the production tubing and an annulus defined exterior to the production tubing. The system also includes a second valve configured to be coupled to the production tubing at a position that is subjacent to the first valve. The second valve is configured to provide selective communication of the wellbore fluid between the interior of the production tubing and the annulus. The system also includes a control line coupled to the first valve and the second valve. The control line is configured to apply a control line pressure to the first and second valves, the control line pressure applied by the control line is independent of an annulus pressure in the annulus and a production tubing pressure in the production tubing. The first valve is configured to actuate from an open position to a closed position, or from the closed position to the open position, at least partially in response to the control line pressure, and the second valve is configured to actuate from an open position to a closed position, or from a closed position to an open position, at least partially in response to the control line pressure.

Embodiments of the disclosure also include a method for operating a gas-lift system including injecting a gas into an annulus between a production tubing and a well. The gas flows from the annulus into the production tubing through a first valve that is open. The method includes closing the first valve by controlling a pressure in a control line that is coupled to the first valve, without causing or permitting a second valve that is subjacent to the first valve to close. The pressure in the control line is independent of a pressure of the gas in the annulus. The method includes increasing the pressure of the gas in the annulus after closing the first valve, such that the gas flows through the second valve and into the production tubing, and closing the second valve by controlling the pressure in the control line, which is also coupled to the second valve, independently of the pressure of the gas in the annulus and independently of a pressure in the production tubing, while maintaining the first valve in a closed position. The method includes retrieving the first valve from within the well without removing the production tubing from the well.

Embodiments of the disclosure further include a gas-lift system including a production tubing extending into a wellbore. An annulus is defined radially between the production tubing and the wellbore. The system also includes a plurality of side-pocket mandrels coupled to the production tubing, each of the side-pocket mandrels defining a primary bore in communication with the production tubing, and a pocket that extends radially outward from an angular interval of the primary bore, a plurality of gas-lift valves configured to selectively communicate the annulus with an interior of the production tubing, each of the plurality of gas-lift valves being received into the pocket of a respective one of the side-pocket mandrels, a surface system comprising a pump configured to pump a hydraulic fluid, and a control line extending from the surface system to the plurality of gas-lift valves, the control line being configured to deliver the hydraulic fluid from the pump to the plurality of gas-lift valves to control opening and closing of the gas-lift valves independently of a pressure in the annulus and independently of a pressure in the production tubing.

BRIEF DESCRIPTION OF THE DRAWINGS

The present disclosure may best be understood by referring to the following description and accompanying drawings that are used to illustrate some embodiments. In the drawings.

DETAILED DESCRIPTION

Figure 1:
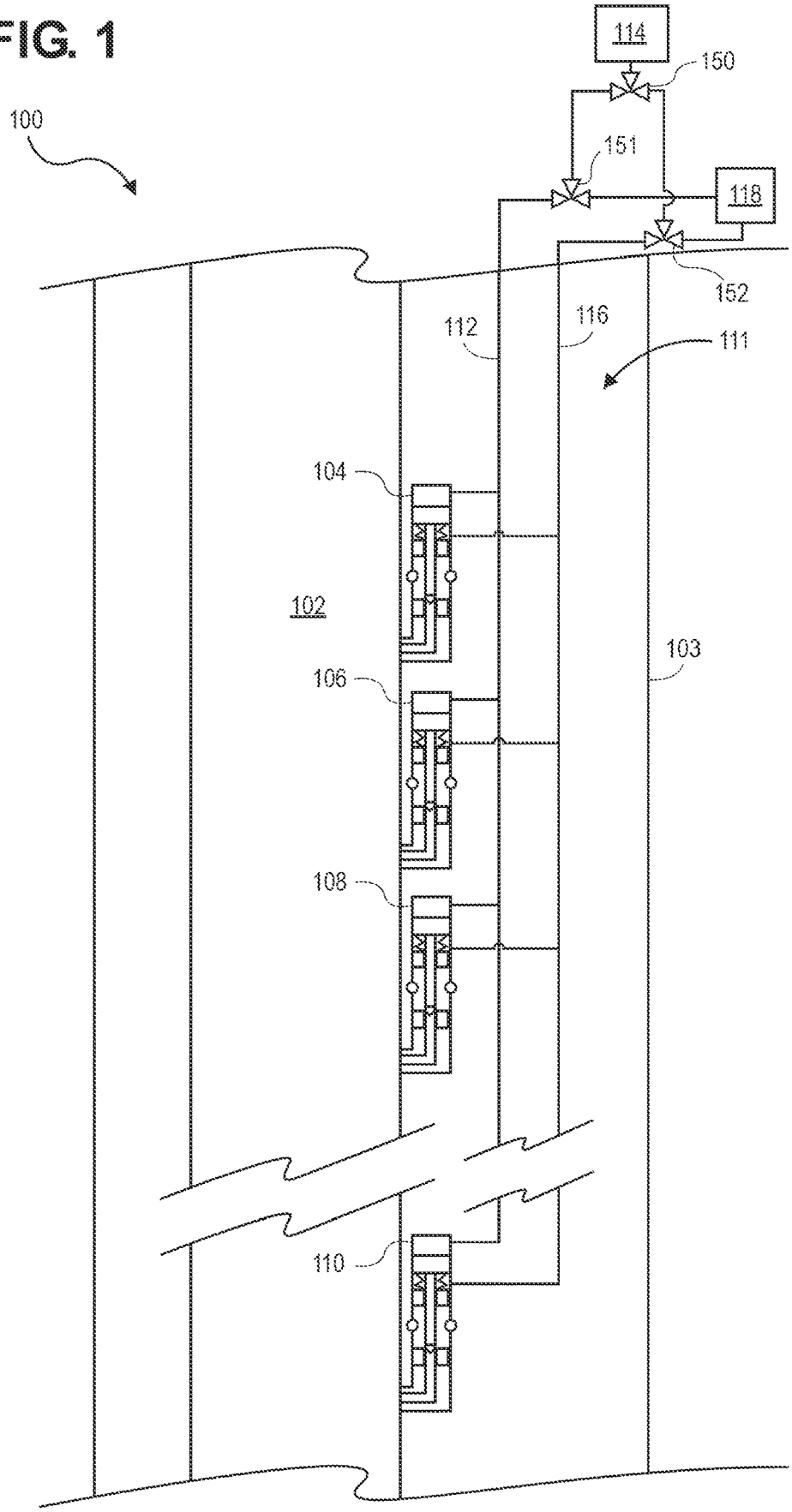
FIG. 1 illustrates a side, schematic view of a dual-line gas-lift system in a well, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, schematic view of a gas-lift system 100, according to an embodiment. The gas-lift system 100 may be configured to reduce a hydrostatic pressure in a production tubing 102 that is deployed into a well 103. Thus, the gas-lift system 100 may be configured to aid in the production of reservoir fluid (e.g., hydrocarbons) from the well 103, at the lower extent of the production tubing 102, through the production tubing 102, and up to the surface above the production tubing 102.

The gas-lift system 100 may include a plurality of valves (by way of example, four are shown: 104, 106, 108, 110, although any number may be employed), which may be positioned in an annulus 111 between the production tubing 102 and the well 103. For example, the valve 104 may be the shallowest valve, the valve 106 may be subjacent to the valve 104, the valve 108 may be subjacent to the valve 106, and the valve 110 may be the deepest valve and subjacent to the valve 108. In some embodiments, additional valves may be employed, e.g., between the valve 108 and the valve 110.

First and second control lines 112, 116 may extend from a surface system (e.g., located at the ground-level) to the valves 104, 106, 108, 110 and may be connected thereto in parallel as shown. As used herein, the terms "connected" and "coupled" mean directly connected/coupled (i.e., without intervening components) or connected/coupled via one or more intermediate components. That is, both possibilities are contemplated by the use of either term.

The surface system may include a pressurized fluid source 114, such as a pump, and a tank 118. The tank 118 may include one or more devices configured to modulate a pressure of the fluid therein, e.g., a piston. In other embodiments, the tank 118 may simply hold the fluid, and such that hydrostatic pressure generated by the height of the control line 112, 116 coupled thereto acts on the valves 104-110. In some embodiments, the surface system may also include one or more valves 150, 151, 152 that are configured to control which control line 112, 116 is connected to the pressurized fluid source 114 and the tank 118. For example, in a first configuration, the pressurized fluid source 114 may be connected via the valves 150, 151 to the first control line 112, while the tank 118 may be connected via the valve 152 to the second control line 116. In a second configuration, the valves 150-152 may be modulated such that the tank 118 may be connected to the first control line 112 via the valve 151, and the pressurized fluid source 114 may be connected to the second control line 116 via the valves 150, 152.

Each of the valves 104, 106, 108, 110 may have a different actuation pressure differential. The actuation pressure differential may be the value for the pressure differential between the first and second control lines 112, 116 at which the valves 104, 106, 108, 110 actuate, either to close or open, as will be described in greater detail below. For example, the valve 104 may be configured to close in the presence of a first pressure differential value and remain closed at lower pressure differential values. The valve 106 may be configured to close in the presence of a second pressure differential value that is greater than the first pressure differential value and remain closed at lower pressure differential values. This pattern of increasing closing pressure differential values may continue for subjacent valves 106, 108, 110. In other embodiments, the pressures may vary as between valves 104-110 in any suitable pattern.

When the valves 104-110 are open, the valves 104-110 permit fluid to flow from the annulus 111 into the production tubing 102. Specifically, gas may be injected into the annulus 111, which is otherwise full of liquid (or a combination of liquid and gas, i.e., a fluid). As the gas pressure in the annulus 111 (the "annulus" pressure) increases, the interface between the gas and liquid is driven downwards. When the valves 104-110 are closed, the valves 104-110 block fluid flow therethrough and into production tubing 102. When the valves 104-110 are open, they allow gas flow into the production tubing 102, generally at the depth where the top-most open valve 104-110 is positioned.

By using pressure in one or more control lines 112, 116 (the "control line" pressure(s)) to control actuation, rather than the annular pressure of the wellbore fluid that resides in the annulus 111 and is received into the production tubing 102 through any of the valves 104-110 that are open, the gas-lift system 100 may be able apply a greater range of pressures to actuate the valves 104-110. For example, the range of actuation pressures supplied by the control line pressure of the control lines 112, 116 may be above pressures that, if experienced in the wellbore fluid in the annulus 111, would damage the well 103 and/or are beyond the practical capabilities of wellbore pumping equipment that is commonly used for artificial lift. In some applications, gas injection into the annulus 111 may be generally performed at between about 20 psi to about 80 psi, and thus, if injection pressure is used to actuate the valves 104-110, valve actuation pressures are also in this range. However, since a separate hydraulic pressure differential is employed in the present system 100, the valve actuation pressures can be outside of this range, e.g., through pumping a generally incompressible, hydraulic fluid that can be raised to much higher pressures, if desired. Further, the hydrostatic pressure acting through one or both of the lines 112, 116 can be employed either to "balance" the pressure in the valve 104-110 or to assist in opening or closing the valve 104-110, as will be described in greater detail below. It will be appreciated that one or more valves that are not actuated via the control lines 112, 116 may also be included in the system 100.

Figure 2:
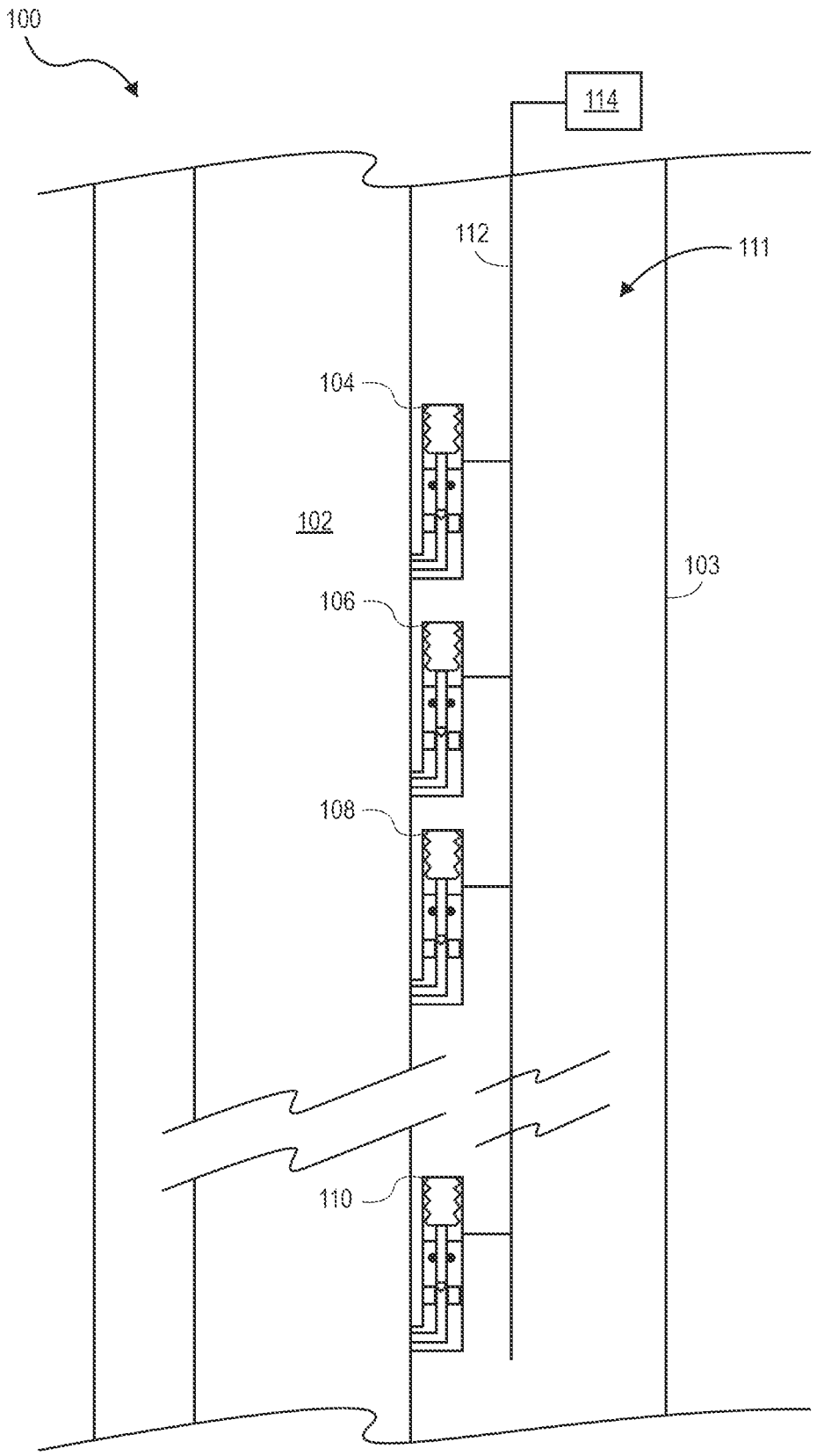
FIG. 2 illustrates a side, schematic view of a single-line gas-lift system in the well, according to another embodiment.

FIG. 2 illustrates a side, schematic view of another gas-lift system 200, according to an embodiment. The gas-lift system 200 of FIG. 2 may be similar and used in a similar context as the gas-lift system 100, and like elements are given like numbers between FIGS. 1 and 2. The second control line 116 is omitted from the gas-lift system 200, and thus the gas-lift system 200 may be referred to as a "single control line" gas-lift system 100. Further, the gas-lift system 200 includes valves 204, 206, 208, 210, which may be positioned and configured to permit or block fluid from communicating from the annulus 111 to the production tubing 102, similarly to valves 104, 106, 108, and 110.

More particularly, the first control line 112 is connected to the valves 204-210, e.g., in parallel, is isolated from the annulus 111, and, in this embodiment, is the only line employed to supply pressure to the valves 204-210 from the pressurized fluid source 114. Accordingly, the tank 118 and valves 151, 152 may also be omitted, or could be included in some embodiments for pressure control, etc. in a suitable arrangement. The valves 204-210 may be configured to be opened or closed in response to the first control line 112 supplying above or below a certain pressure. For example, the valves 204-210 may be biased closed, and, when the pressure supplied by the first control line 112 reaches the actuation pressure, the pressure may force the valve open. Alternatively, the valves 204-210 may be biased open, and a pressure supplied by the first control line 112 may force the valves 104-110 closed, and may be lowered to allow the valves 104-110 to open.

The valves 104-110 of FIG. 1 and the valves 204-210 of FIG. 2 are illustrated schematically as fixed to the exterior of the production tubing 102. This is merely one possibility, however. In another example, any one or more of the valves 104-110, 204-210 may be positioned in a "side-pocket" mandrel, and may thus be retrievable through the production tubing 102, e.g., without removing the production tubing 102 from the well 103, using wireline equipment deployed from the surface through the production tubing 102. In some embodiments, one or more of the valves 104-110, 204-210 may be in such a side-pocket mandrel, and one or more of the other valves 104-110, 204-210 may be attached to the exterior of the production tubing 102.

Figure 3:
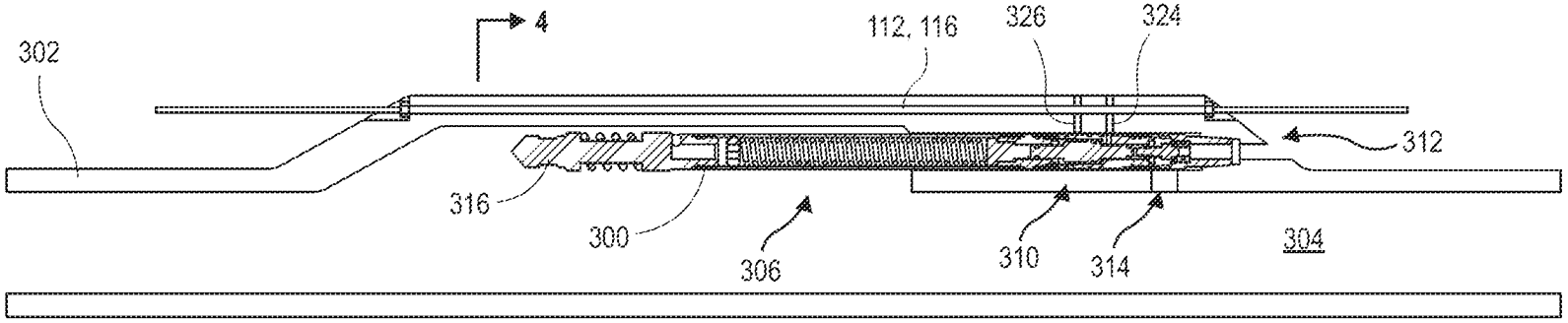
FIG. 3 illustrates a side, cross-sectional view of a gas lift valve of the gas-lift system in a side-pocket mandrel, according to an embodiment.
Figure 4:
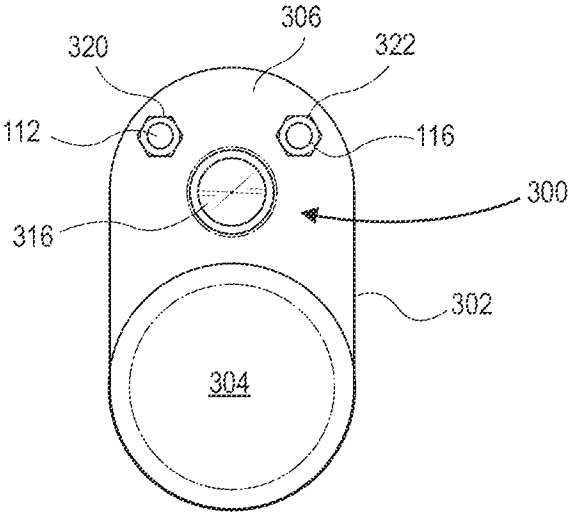
FIG. 4 illustrates a cross-sectional view of the gas lift valve in the side-pocket mandrel, taken along line 4-4 in FIG. 3, according to an embodiment.

FIG. 3 illustrates a side, cross-sectional view of an embodiment of a valve 300 positioned in a side-pocket mandrel 302 of a gas-lift system, such as the gas-lift system 100 or 200 discussed above. FIG. 4 illustrates an axial cross-sectional view of the valve 300 installed in the side-pocket mandrel 302, according to an embodiment. The valve 300 may be representative of any one or more of the valves 104-110 and/or 204-210 or others.

The side-pocket mandrel 302 may connected to, fit on, be received around, or otherwise used in conjunction with the production tubing 102 (e.g., FIGS. 1 and 2). For example, a primary bore 304 may be formed through the side-pocket mandrel 302, which may serve to permit fluid flow through the production tubing 102, e.g., between either axial end of the primary bore 304. The side-pocket mandrel 302 may also include a pocket 306, e.g., formed by the wall of the side-pocket mandrel 302 extending radially outward along an angular interval of generally less than 180 degrees around the primary bore 304. Accordingly, the side-pocket mandrel 302 may be non-axisymmetric at the pocket 306. At least a portion of the pocket 306 may be open to communication with the primary bore 304, allowing for access to the pocket 306, e.g., from the surface via suitable installation or removing tools, e.g., wireline or slickline tools.

The valve 300 may be positioned at least partially in the pocket 306. An axially-extending bore 310 may be formed through the side-pocket mandrel 302 on a lower end of the pocket 306. The bore 310 may be configured to communicate with the annulus 111 via an opening 312. The bore 310 may also be configured to communicate with the interior of the production tubing 102 via a radial port 314. A lower portion of the valve 300 may be received into the bore 310 and secured therein. The valve 300 may include an adaptive feature configured to be engaged by a wireline retrieval tool for installing the valve 300 into and/or removing the valve 300 from the pocket 306. In an embodiment, as shown, the adaptive feature may be an adapter 316 that is connected to (e.g., received at least partially in) the upper end of the valve 300, but in other embodiments, could be formed integrally with the remainder of the valve 300.

In this embodiment, there are two control lines 112, 116, although, as discussed above, the gas-lift system 100 could be implemented with a single control line 112. The control lines 112, 116 may extend axially through the mandrel 302 where the mandrel 302 defines the pocket 306, e.g., through bores 320, 322 defined therein, as shown. In other embodiments, the control lines 112, 116 may be connected to the bores 320, 322, but may not extend therethrough. The bores 320, 322 may be parallel and offset from one another, as shown, e.g., at about the same radial distance from the center of the production tubing 102. In other embodiments, the bores 320, 322 may be formed elsewhere in the pocket 306. Further, the control lines 112, 116 may extend radially through at least a portion of the pocket 306 via radial ports 324, 326, respectively, so as to communicate with the bore 310. For example, the first line 112 may communicate with the bore 310 at an axially lower position than the second line 116, as shown, although this could be reversed. The control lines 112, 116 may extend within the annulus 111 above and below the pocket 306.

As will be explained in greater detail below, the valve 300 positioned in the side-pocket mandrel 302 may be configured to be actuated (i.e., opened or closed) responsive to the pressure (or pressure differential) in the control lines 112, 116, independently of pressure in the production tubing 102 and/or in the annulus 111 (e.g., FIG. 1). When opened, the valve 300 may permit fluid communication between the opening 312 and the radial port 314, thereby allowing fluid (generally, gas injected into the annulus 111) into the production tubing 102 from the annulus 111. When closed, the valve 300 may block such fluid flow therethrough. Thus, the valve 300 may provide a retrievable gas-lift valve that is controllable separately from pressure within the annulus 111.

Figure 5:
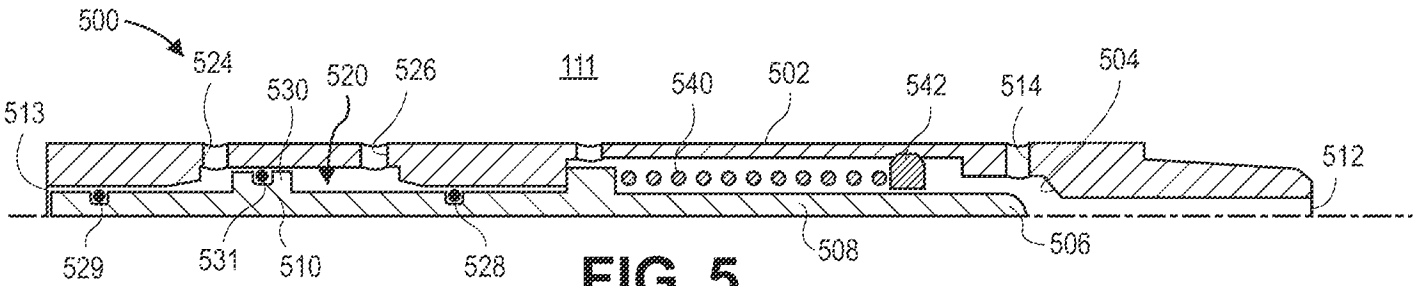
FIG. 5 illustrates a partial, side, cross-sectional view of the valve of the gas lift system, according to an embodiment.

FIG. 5 illustrates a partial, side, cross-sectional view of a valve 500, according to an embodiment. The valve 500 may be an example of one or more of the valves 104-110 and/or 300 used in the gas-lift system 100. In some embodiments, an adapter, such as the adapter 316 of FIG. 3, may be added to the valve 500 so that it may be installed into and retrievable from a side-pocket mandrel (e.g., side-pocket mandrel 302). The valve 500 may have a default open position, such that a pressure differential between the first control line 112 and the second control line 116 may be generated or otherwise used to close the valve 500.

For example, the valve 500 may include a housing 502, a seat 504, a valve closure element 506, an elongate rod 508, and a piston 510. The housing 502 may be a unitary structure, as shown, or may be made from two or more bodies that are connected (e.g., threaded) together. The housing 502 may define an open axial end or "opening" 512, which may be in communication with the interior of the production tubing 102 (e.g., providing the orifice 202 of FIG. 2). The housing 502 may also be open to the annulus 111 on its opposite axial end 513. A primary port 514 may be defined through the housing 502, which may communicate the surrounding environment within the annulus 111 with the interior of the housing 502.

The seat 504 may be interposed between the port 514 and the open axial end 512. For example, the seat 504 may be defined by or connected to the housing 502. Further, the valve closure element (e.g., a dome-shaped or otherwise partially spherical member, a conical member, etc.) 506 may be engageable with the seat 504, to selectively permit or block communication of fluid from the port 514 to the open axial end 512.

The valve closure element 506 may be coupled to the rod 508, which may be in turn coupled to the piston 510. In some embodiments, these structures 506-510 may be formed as a single piece, but in other embodiments, may be made separately and connected together. Accordingly, the valve closure element 506 may be moved by movement of the piston 510, with such movement being transmitted therebetween by the rod 508. The piston 510 may be positioned within a chamber 520 defined in the housing 502. For example, a first control port 524 and a second control port 526 may be defined through the sub 522. The first control port 524 may be in fluid communication with the first control line 112, and the second control port 526 may be in fluid communication with the second control line 116. Accordingly, fluidic pressure within the control lines 112, 116 may be communicated into the chamber 520 via the first and second control ports 524, 526, respectively. The chamber 520 may be sealed from the rest of the interior of the housing 502 via one or more seals 528, 529 between the piston 510 and the housing 502, such that fluid in the control lines 112, 116 is maintained separate from the fluid in the annulus 111 that is received into the housing 502 via the ports 514.

The piston 510 may include a radially-enlarged section 530, which may include a seal 531 for sealing with an inner surface of the chamber 520, while allowing movement of the piston 510 relative to the housing 502, e.g., responsive to pressure differentials. The radially-enlarged section 530 may be proximal to a middle of the piston 510, such that the piston 510 separates the chamber 520 between the first and second control ports 524, 526. Accordingly, a higher pressure in the first control line 112, communicated into the chamber 520 via the first control port 524, in comparison to a lower pressure in the second control line 116, communicated into the chamber 520 via the second control port 526, may force the piston 510 downward, e.g., to the right, as shown. This may force the valve closure element 506 into engagement with the seat 504, thereby closing the valve 500 (preventing fluid communication from the port 514 through the open axial end 512). Similarly, a higher pressure in the second control line 116 relative to the first control line 112 may force the piston 510 upward, e.g., to the left, as shown, raising the valve closure element 506 away from the seat 504, opening the valve 500 and permitting fluid communication between the port 514 and the open axial end 512.

In an embodiment, the valve 500 may be a spring-force valve. For example, the valve 500 may also include a biasing member 540, such as a spring. In an embodiment, the biasing member 540 may be coiled around the rod 508, as shown. The valve 500 may further include a nut 542, which may be positioned in the housing 502, e.g., threaded into position therein. As such, the nut 542 may be configured to retain its position in the housing 502, despite axial loads from the biasing member 540. The rod 508 may extend through the nut 542 and may be configured to slide relative thereto. The biasing member 540 may also bear against the piston 510, e.g., via a connecting member 544 between the rod and the piston 510.

The biasing member 540 may be configured to apply a biasing force that tends to hold the valve 500 open, e.g., with the valve closure element 506 held away from the seat 504. The nut 542 may be positioned to vary the level of biasing force applied, and it will be appreciated that the biasing force may vary depending on the position of the piston 510. Accordingly, when the pressure differential across the piston 510 generates a sufficient downward force, the biasing force of the biasing member 540 may be overcome, permitting the piston 510 to move downward, and thus forcing the valve closure element 506 into engagement with the seat 504, so as to close the valve 500.

Figure 6:
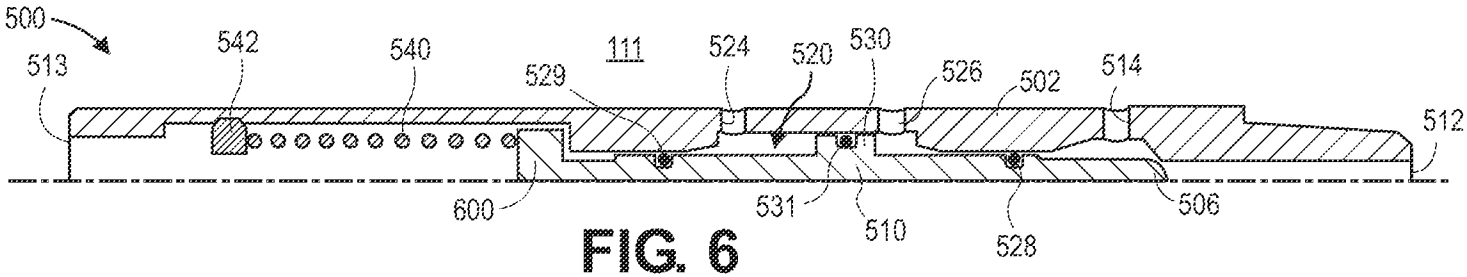
FIG. 6 illustrates a partial, side, cross-sectional view of another embodiment of the valve of the gas-lift system.

FIG. 6 illustrates a partial, side, cross-sectional view of another embodiment of the valve 500. In this embodiment, the valve 500 may default to being closed. In the illustrated example, the valve 500 may not include the rod 508. Rather, the piston 510 may be directly connected to the valve closure element 506.

Further, a force-transmission member 600 may engage an opposite side of the piston 510. The biasing member 540 may bear upon the force-transmission member 600 and the nut 542, such that the biasing member 540 is configured to press the force-transmission member 600 downward, to the right, as shown, thereby biasing the valve closure element 506 into engagement with the seat 504. The force-transmission member 600 may also bear against an end of the piston 510. The force-transmission member 600 may be slidable relative to the housing 502. Accordingly, to open the valve 500, the piston 510 is forced upwards by a pressure differential in the chamber 520, e.g., by pressure in the first control line 112 exceeding pressure in the second control line 116 by a predetermined value, such that the pressure differential overcomes the biasing force generated by the biasing member 540.

Figure 7:
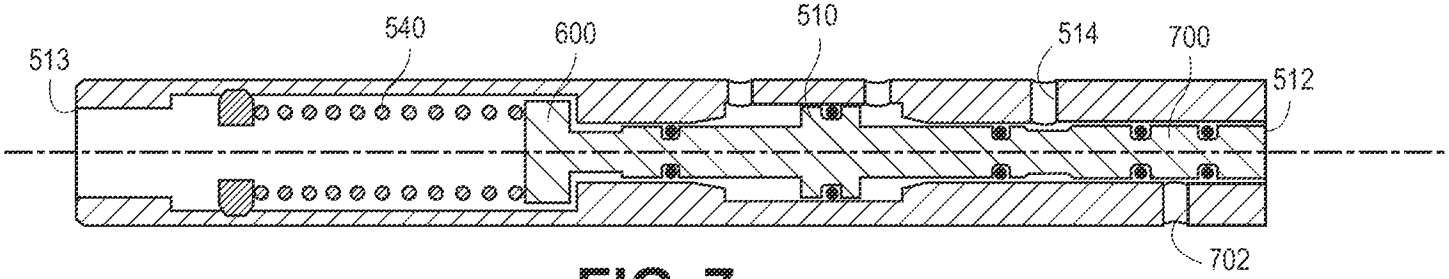
FIG. 7 illustrates a side, cross-sectional view of another embodiment of the valve of the gas-lift system.

FIG. 7 illustrates a side, cross-sectional view of the valve 500, according to another embodiment. In this embodiment, the valve 500 has a valve closure element 700 and includes a secondary port 702 that communicates with the production tubing 102. The open axial end 512 may open to the annulus 111 instead of the production tubing 102.

For example, the valve closure element 700 may be or include a piston, which may extend from and move with the piston 510 that is positioned in the chamber 520. As with other embodiments, the piston 510 is moved by a pressure differential between the control lines 112, 116 as communicated into the chamber 520 via the control ports 524, 526. The valve closure element 700 may slide within the housing 502, such that, in a closed position (as illustrated) the valve closure element 700 blocks fluid flow into the secondary port 702, e.g., from either/both of the open axial end 512 and/or the port 514. Furthermore, the valve closure element 700 may include a pair of seals 704, 706, which, in the closed position, are located on both axial sides of the secondary port 702. In other embodiments, the seals 704, 706 may be positioned on both axial sides of the port 514, or on both axial sides of both ports 514, 702. The seals 704, 706 (or others) may form a seal between the housing 502 and the valve closure element 700, so as to prevent fluid flow into the secondary port 702 when the valve closure element 700 is in the closed position.

In the illustrated embodiment, the valve 500 of FIG. 7 may default to closed, similar to the valve 500 of FIG. 6, as the biasing force is applied by the biasing member 540 on the force-transmission member 600 presses the valve closure element 700 to the closed position (to the right in this view). For example, the biasing member 540 may press against the force-transmission member 600, pressing the force-transmission member 600 onto a shoulder of the housing 502, as shown, which prevents further movement of the force-transmission_member 600. In other embodiments, the valve closure element 700 may instead be configured to default to the open position, similar to the valve 500 of FIG. 5, by configuring the biasing member 540 to bias the valve closure element 700 toward the open position (to the left in this view) rather than the closed position.

When the valve closure element 700 is moved to the open position, e.g., by the piston 510 being driven (to the left, as shown) by the pressure differential in the chamber 520, the valve closure element 700 may permit fluid flow from either/both of the open axial end 512 and/or the port 514 to the secondary port 702. For example, the valve closure element 700 may be moved uphole (to the left, in this illustration), such that the seals 704, 706 no longer block fluid flow into the port 702. In some embodiments, fluid flow from the port 514 into the port 702 may be blocked even when the valve closure element 700 is moved to the open position, while fluid flow may be permitted to reach the port 702 via the open axial end 512.

The valve 500 may be configured to balance the pressures applied thereto from sources other than the control lines 112, 116. For example, pressure within the annulus 111 may be balanced across the internal components (including the valve closure element 700) between the two open axial ends 512, 513 and/or the port 514. Further, because the valve closure element 700 slides across the port 514, rather than moving directly against a valve seat in the flow path, the valve closure element 700 may not be forced to push against the pressure of the fluid in the production tubing 102. Such pressure balancing (and/or avoidance) may enable operators to control actuation without consideration for (or at least mitigating the effects of) pressure in the annulus 111 and/or production tubing 102.

In at least one embodiment, an upper end of the valve 500 of FIGS. 5-7 may include a wireline adapter, such as the wireline adapter 316 of FIGS. 3 and 4. The adapter 316 may be connected to the housing 502 or any other suitable structure provided by the valve 500, such that the adapter 316 is engageable by the wireline tool. Accordingly, the adapter 316 may permit retrieval of the valve 500 using a wireline tool deployed through the production tubing 102, with the valve 500 being positioned in a pocket 306 of a side-pocket mandrel 302, as discussed above with reference to FIGS. 3 and 4.

Figure 8:
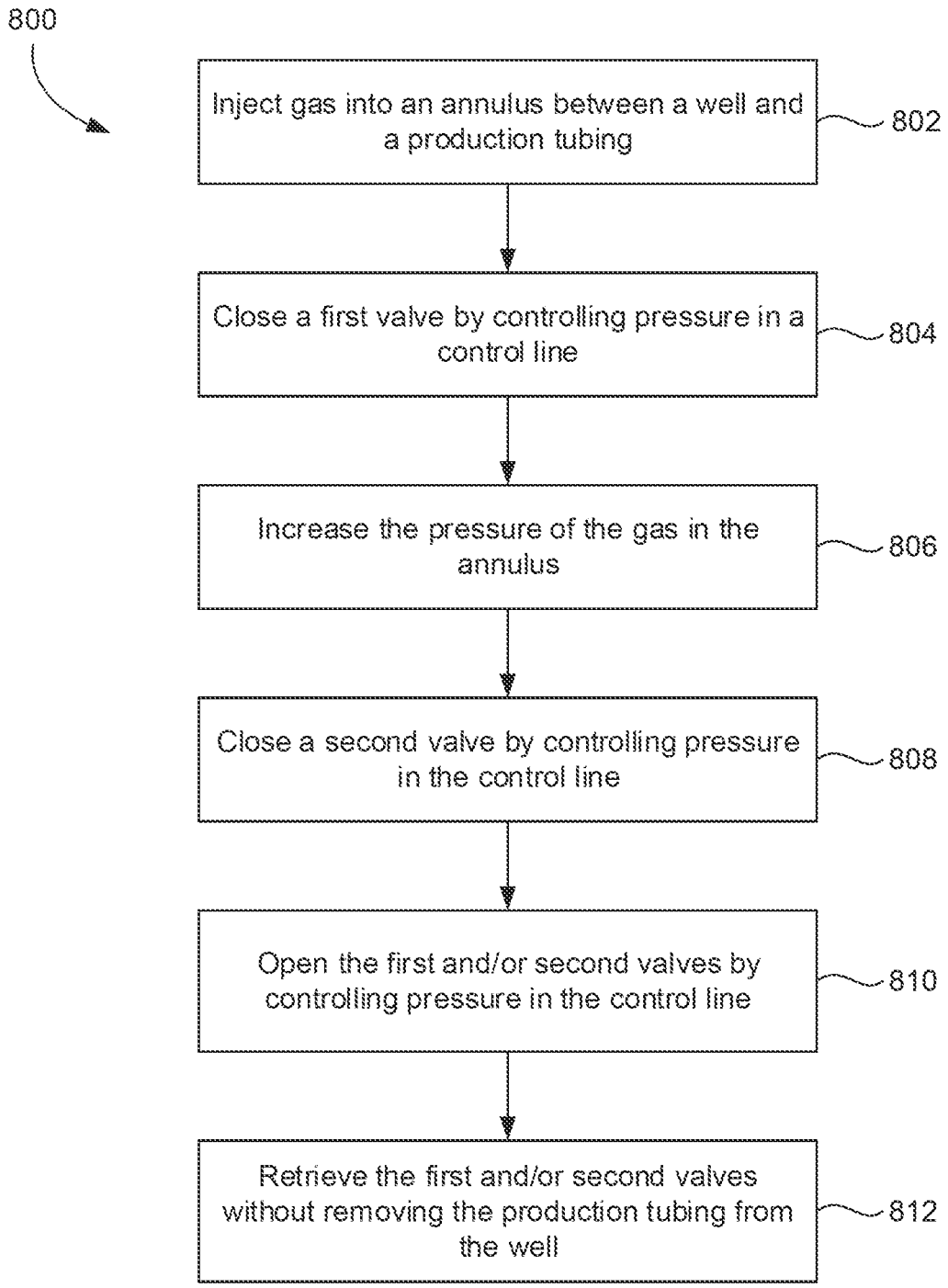
FIG. 8 illustrates a flowchart of a method for operating a gas-lift system, according to an embodiment.

FIG. 8 illustrates a flowchart of a method 800 for operating a gas-lift system, e.g., the gas-lift system 100 and/or 200, according to an embodiment. Although the method 800 is described with reference to the gas-lift system 100, it will be appreciated that the method 800 may, in some embodiments, be executed using other structures. Moreover, the steps of the method 800 discussed herein may be performed in a different order than described, two or more steps may be combined into one, some of the steps may be separated into two or more steps each, steps may be done simultaneously, without departing from the scope of the present disclosure.

The method 800 may include injecting a gas into an annulus 111 between a production tubing 102 and a well 103, as at 802. The injected gas flows from the annulus 111 into the production tubing 102 through a first valve (e.g., valve 104) that is open.

The method 800 may also include closing the first valve 104 by controlling a pressure in a control line 112 (and/or 116) that is coupled to the first valve 104, without causing or permitting a second valve 106 that is subjacent to the first valve 104 to close, as at 804. In some embodiments, the pressure in the control line 112 is independent of a pressure of the gas in the annulus 111 and/or a pressure of the gas or liquid in the production tubing 102 (e.g., the first control line 112 does not rely on pressure in the annulus 111 or in the production tubing 102 to assist in actuating the first valve 104). In an embodiment, closing the first valve 104 includes increasing the pressure in the control line 112 such that a pressure differential generated at least partially by pressure in the control line 112 overcomes a biasing force configured to bias the first valve to an open position. In another embodiment, closing the first valve 104 includes reducing the pressure in the control line 112 such that a pressure differential generated at least partially by the pressure in the control line 112 does not overcome a biasing force configured to bias the first valve 104 to a closed position.

The method 800 may also include increasing the pressure of the gas in the annulus 111 after closing the first valve 104, as at 806. This may drive the gas-liquid interface in the annulus 111 in a downhole direction, such that the gas flows through the second valve 106 and into the production tubing.

The method 800 may further include closing the second valve 106 by controlling the pressure in the control line 112, as at 808. The control line 112 may be the same control line that is coupled to the second valve 106, and the pressure in the control line 112 may be controlled independently of the pressure of the gas in the annulus 111, while maintaining the first valve 104 in a closed position. Further, the control line 112 may control the pressure in the second valve 106 independently of the pressure within the production tubing 102 (e.g., the control line 112 does not rely on the pressure within the production tubing 102 or the annulus 111 to assist in actuating the second valve 106). It will be appreciated that controlling the pressure in the control line 112 "independently" of the pressure in the annulus 111 means that the pressure in the control line 112 could, for example, change while the pressure in the annulus 111 remains constant, or remain constant while the pressure in the annulus 111 remains the same, or change by a different amount than the pressure in the annulus changes 111, etc.

In an embodiment, the method 800 may also include opening the first and second valves 104, 106 by controlling the pressure in the control line 112 such that a pressure differential generated at least partially by the pressure in the control line 112 causes or permits the first and second valves 104, 106 to open, as at 810.

The method 800 may additionally include retrieving the first valve 104, the second valve 106, any other gas-lift valves, or a combination thereof, from within the well 103 without removing the production tubing 102 from the well, as at 812. In an embodiment, the first valve 104 (embodied as the valve 300) is positioned in a pocket 306 of a side-pocket mandrel 302, and retrieving the first valve 104 includes removing the first valve 104 from the pocket 306. In an embodiment, retrieving the first valve 104 includes removing the first valve 104 from within a bore 310 defined in the side-pocket mandrel 302. The bore 310 has an opening 312 that communicates with the annulus 111 and a radial port 314 that communicates with the production tubing 102 via a primary bore 304 of the side-pocket mandrel 302. The control line 112 extends axially through the side-pocket mandrel 302, where the mandrel 302 defines the pocket 306. In an embodiment, retrieving the first valve 104 may include engaging an adapter 316 of the first valve 104 using a wireline tool.

Figure 9:
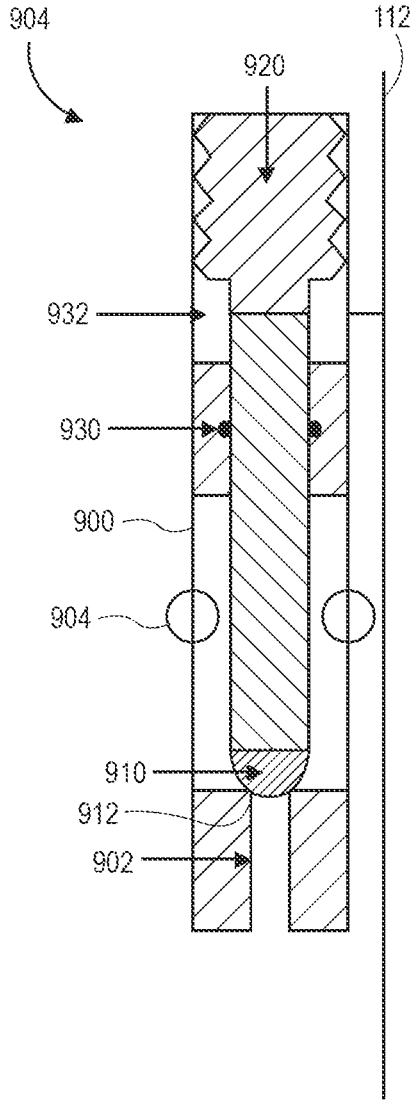
FIG. 9 illustrates a side, cross-sectional view of a valve in a closed position, for use in the single control-line embodiment of the gas-lift system, according to an embodiment.

FIG. 9 illustrates a side, schematic view of one of the valves 204-210, e.g., of the gas-lift system 200 of FIG. 2, according to an embodiment. With continuing reference to FIGS. 2 and 9, for purposes of discussion, the valve is labeled as valve 204, but it will be appreciated that the valve 204 may be representative of any or all of the other valves 204-210. The valve 204 is illustrated in a closed position, in which the valve 204 blocks or otherwise prevents fluid flow from the annulus 111 to the interior of the production tubing 102 via the valve 204. This may be the "normal" or "default" position of the valve 204. In other embodiments, the valve 204 may default to an open position in which fluid communication between the annulus 111 and the interior of the production tubing 102 is permitted. Further, some gas-lift systems may employ both default-open and default-closed valves.

In the illustrated embodiment, the valve 204 may include a housing 900, which may extend longitudinally, generally parallel to the production tubing 102. The housing 900 may define an orifice 202, which may communicate with the interior of the production tubing 102. The orifice 902 may be formed or defined by a partially or entirely open axial end of the housing 900. The housing 900 may also include an inlet opening 904, which may be oriented laterally through part of the housing 900, so as to allow fluid from the annulus 111 to enter the housing 900.

Within the housing 900, the valve 204 may include a valve element 910 and a valve seat 912. The valve element 910 may engage the valve seat 912 and form a seal therewith, as shown, with the valve 204 is in a closed position. The valve element 910 and the valve seat 912 may thus serve to block or otherwise prevent fluid communication between the inlet opening 904 and the orifice 902. This may prevent fluid flow from the annulus 111 to within the production tubing 102 via the valve 204. In some embodiments, the valve element 910 may be a generally cylindrical stem with a spherical end that engages the valve seat 912.

The valve 204 may also include a biasing member 920. The biasing member 920 may be coupled to the valve element 910. In the illustrated, default-closed embodiment, the biasing member 920 may press the valve element 910 toward the valve seat 912, such that, in the absence of a sufficient opposing force, the valve element 910 may engage the valve seat 912 and close the valve 204. In a default-open embodiment, the biasing member 920 may serve to apply a force that drives the valve element 910 away from the valve seat 912.

In some embodiments, the biasing member 920 may be a bellows, such as a gas-charged (e.g., nitrogen-charged) bellows. Operators may charge the biasing member 920 to a certain pressure at the surface. The biasing member 920 may thus be pressured to allow the valve 204 to actuate (from closed to open, or open to closed, depending on the embodiment) in the presence of a pressure that exceeds a hydrostatic pressure at the position in the well at which the valve 204 may be positioned. Accordingly, different valves in a single gas-lift system 200 may have different pressures in the biasing member 920 in such a bellows embodiment. In other embodiments, other types of bellows may be used (e.g., any other suitable gas). In other embodiments, springs, Bellville washers, etc. may be used as the biasing member 920, and configured to oppose actuation until a certain pressure, above the hydrostatic pressure, is applied.

The valve 204 may also include a seal 930, which may seal with the valve element 910 and the housing 900. The valve element 910 may be movable with respect to the seal 930, e.g., able to slide therepast. The seal 930 may the positioned to form a sealed chamber 932 in the valve 104. In an embodiment, the biasing member 920 may be positioned in the sealed chamber 932, such that a pressure in the sealed chamber 932, outside of the biasing member 920, may act upon the biasing member 920. The pressure may serve to compress the biasing member 220. In a spring or other mechanical embodiment of the biasing member 220, a piston, block, shoulder, etc. may be used to compress (or extend) the biasing member 220.

The control line 112 may communicate with the sealed chamber 932. Accordingly, the pressure in the control line 112 may be fed directly to the sealed chamber 932 to control the pressure within the sealed chamber 932. The pressure in the control line 112 may thus be used to actuate the valve 204 from the closed positioned illustrated in FIG. 9 to the open position illustrated in FIG. 10.

Figure 10:
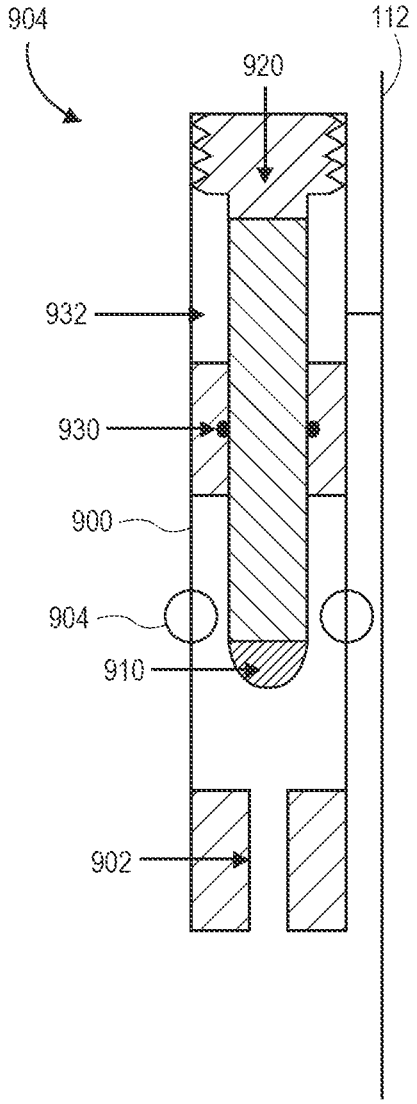
FIG. 10 illustrates a side, cross-sectional view of the valve of FIG. 9 in an open position, according to an embodiment.

Referring to FIG. 10 in greater detail, and still referring to FIG. 2, as shown, the valve element 910 has lifted away from engagement with the valve seat 912, opening the valve 204. As such, there is a fluid communication path opened from the inlet opening 904 to the orifice 902, and thus from the annulus 111 to within the production tubing 102.

As can be seen in FIG. 10, the biasing member 920 has compressed. This is caused by the pressure in the control line 112 increasing, which in turn increases the pressure in the sealed chamber 932. As the pressure in the sealed chamber 932 increases, eventually it overcomes the biasing force applied by the biasing member 920 and compresses the biasing member 920 by an amount sufficient to disengage the valve element 910 from the valve seat 912.

Figure 11:
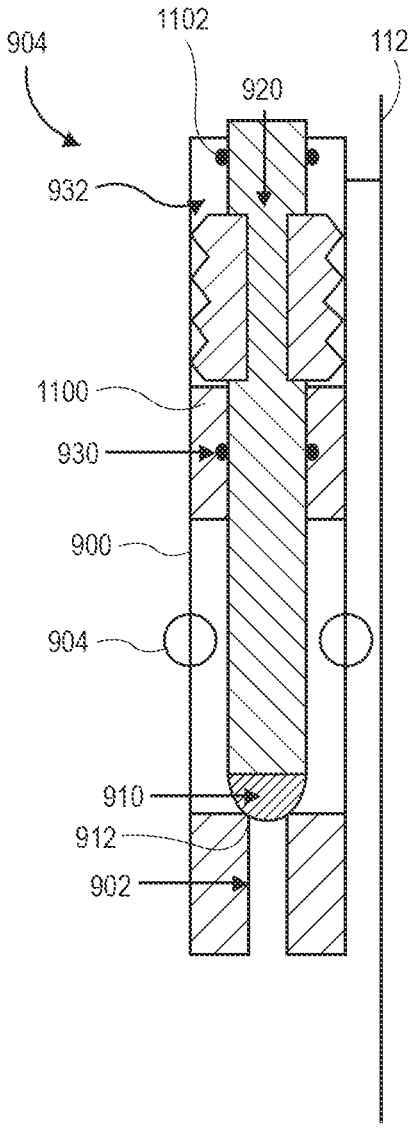
FIG. 11 illustrates a side, cross-sectional view of another valve for use in a single control line gas-lift system, according to an embodiment.

FIG. 11 illustrates a side, schematic view of the valve 204, according to another embodiment. Again, the valve 204 is shown in the closed position, with the valve element 910 engaging the valve seat 912. In this embodiment, the valve element 910 extends through the biasing member 920. Further, the housing 900 may include a block 1100 below the biasing member 920 and a second seal 1102 above the biasing member 920 and within the housing 900. Thus, the sealed chamber 932 may be formed above the biasing member 920. The control line 112 may inject pressure into the sealed chamber 932. The biasing member 920 may press against the block 1100 and a shoulder or other engaging feature of the valve element 910, thereby biasing the valve element 210 upwards, away from the valve seat 912. As such, this embodiment of the valve 204 is biased open. When pressure sufficient to compress the biasing member 920 is received via the control line 112, the biasing member 920 compresses, allowing the valve element 910 to press into engagement with the valve seat 912, closing the valve 204.

Figure 12:
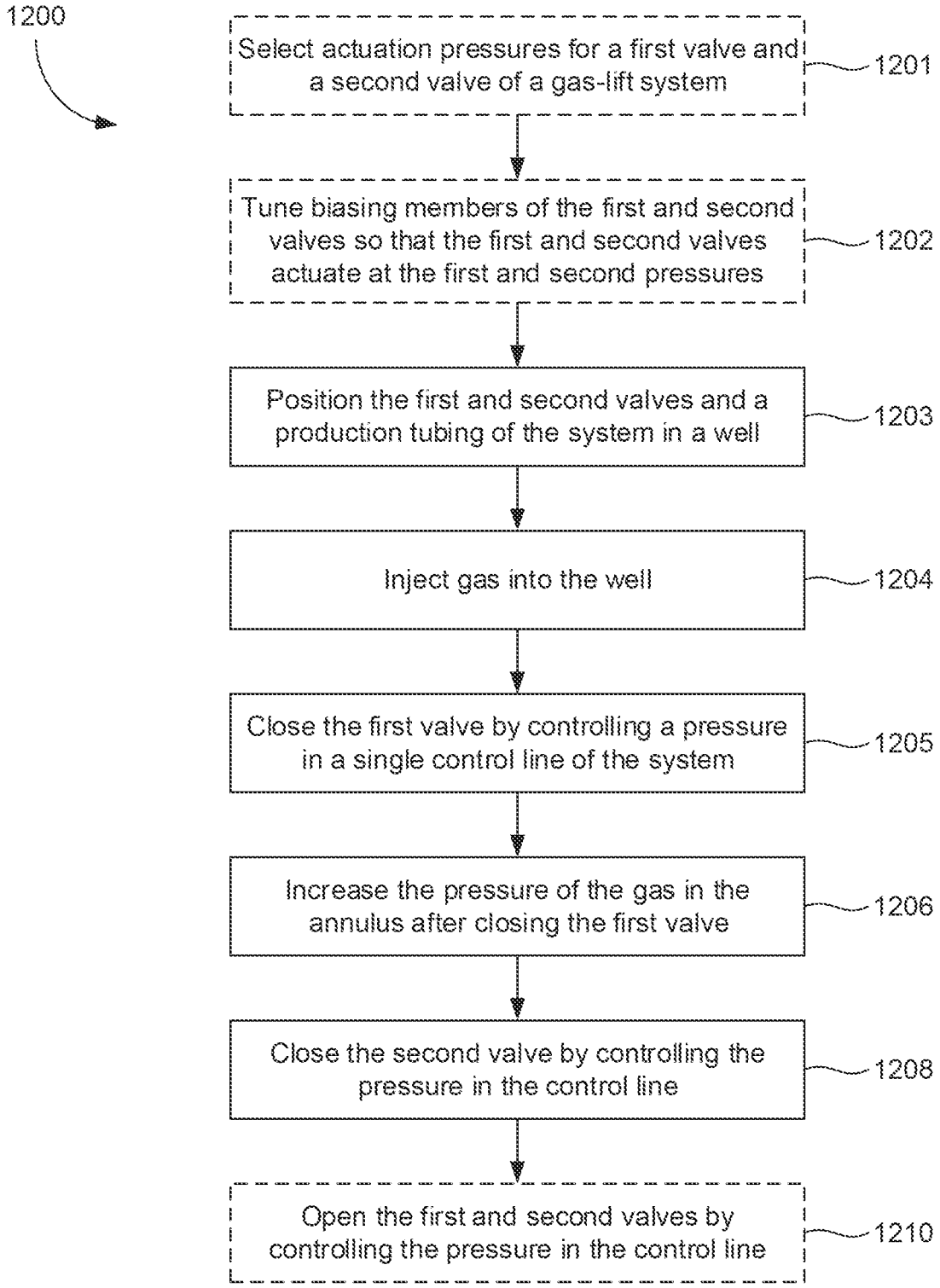
FIG. 12 illustrates a flowchart of a method for operating a gas lift system, according to an embodiment.

FIG. 12 illustrates a flowchart of a method 1200 for operating a gas-lift system, according to an embodiment. In at least some embodiments, the method 1200 may be executed using an embodiment of the gas-lift system 100 and/or 200 discussed above, but in other embodiments, may use other structures, and thus should not be considered limited to any particular structure unless otherwise indicated herein.

In some embodiments, the method 1200 may include selecting first and second pressure values at which first and second valves (e.g., valves 204 and 206) actuate, based on a depth at which the first and second valves 204, 206 are to be deployed, respectively, as at 1201. For example, the pressures may be selected to exceed the hydrostatic pressure at the depth, such that the valves 204, 206 are operable by a control line 112 that is independent of the annulus 111. For example, the pressure may be selected to permit the valves 204, 206 to open upon reaching the first pressure value. Further, the pressure may be selected such that, for example, successively deeper-positioned valves 208, 210 actuate and successively high pressure.

In an embodiment, the method 1200 may also include tuning a biasing member 920 of the first valve 204, the second valve 206, or both, as at 1202. The biasing member 920 of the first valve 204 resists actuation of the first valve 204 until the first pressure value is reached, and the biasing member 920 of the second valve 206 resists actuation of the second valve 206 until the second pressure value that is different from the first pressure value is reached. In some embodiments, the biasing members 920 may be bellows, and tuning the biasing members 920 may include charging the bellows with a gas (e.g., nitrogen) to a predetermined pressure based on the selected first and second pressure values, respectively.

The method 1200 may also include positioning the first and second valves 204, 206 and the production tubing 102 at the selected depths (from 501) in a well 103, as at 1203. The method 1200 may include injecting a gas into an annulus 111 between a production tubing 102 and the well 103, as at 1204. The gas flows from the annulus into the production tubing through a first valve that is open.

The method 1200 also includes closing the first valve 204 by controlling a pressure in a single control line 112 that is coupled to the first valve 204, without causing or permitting a second valve 206 that is subjacent to the first valve 204 to close, as at 1205. The pressure in the control line 112 is independent of a pressure of the gas in the annulus.

The method 1200 may also include increasing the pressure of the gas in the annulus 111 after closing the first valve 204, such that the gas flows through the second valve 206 and into the production tubing 102, as at 1206.

The method 1200 may further include closing the second valve 206 by controlling the pressure in the control line 112, as at 1208. The control line 112 is also coupled to the second valve 206, independently of the pressure of the gas in the annulus 111 (e.g., such that the pressure of the gas in the annulus 111 does not determine or control the pressure of the gas in the control line 112), while maintaining the first valve 204 in a closed position.

In some embodiments, the method 1200 may, for example, before closing the first and/or second valves 204, 206 at 1205 and 1208, or after closing the first and/or second valves 204, 206 at 1205 and 1208, include opening the first and second valves 204, 206, as at 1210, by controlling the pressure in the control line 112 such that a pressure generated at least partially by the pressure in the control line 112 causes or permits the first and second valves 204, 206 to open. Further, in at least some embodiments, the method 1200 may include retrieving the first and/or second valves 204, 206 without removing the production tubing 102 from the well 103, as discussed above.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A gas-lift system, comprising:

a first valve configured to be coupled to a production tubing, wherein the first valve is configured to provide selective communication of a wellbore fluid between an interior of the production tubing and an annulus defined exterior to the production tubing;

a second valve configured to be coupled to the production tubing at a position that is subjacent to the first valve, wherein the second valve is configured to provide selective communication of the wellbore fluid between the interior of the production tubing and the annulus; and a control line coupled to the first valve and the second valve, wherein the control line is configured to apply a control line pressure to the first and second valves, wherein the control line pressure applied by the control line is independent of an annulus pressure in the annulus and a production tubing pressure in the production tubing, wherein the first valve is configured to actuate from an open position to a closed position, or from the closed position to the open position, at least partially in response to the control line pressure, and wherein the second valve is configured to actuate from an open position to a closed position, or from a closed position to an open position, at least partially in response to the control line pressure.

2. The gas-lift system of claim 1, further comprising a side-pocket mandrel coupled to the production tubing and defining a pocket radially outward therefrom, wherein the first valve comprises an adaptive feature for connection to a retrieval tool, and wherein the first valve is configured to be positioned at least partially in the pocket of the side-pocket mandrel such that the first valve is configured to be retrieved through the production tubing, without removing the production tubing from the wellbore.

3. The gas-lift system of claim 2, wherein the control line extends at least partially axially through the side-pocket mandrel or connects to a bore that extends at least partially axially through the side-pocket mandrel.

4. The gas-lift system of claim 2, wherein:

the control line is a first control line and the control line pressure is a first control line pressure;

the gas-lift system further comprises a second control line coupled to the first valve and the second valve, the second control line being configured to apply a second control line pressure to the first valve and to the second valve;

the first valve is configured to actuate from the closed position to the open position, or from the open position to the closed position, in response to a pressure differential between the first control line pressure and the second control line pressure reaching a first value; and the second valve is configured to actuate from the open position to the closed position, or from the closed position to the open position, in response to the pressure differential reaching a second value, the first value being different from the second value.

5. The gas-lift system of claim 4, wherein the first valve comprises:

a chamber;

a piston positioned in the chamber, wherein the first control line communicates with the chamber on a first side of the piston, and wherein the second control line communicates with the chamber on a second side of the piston; and a biasing member configured to resist movement of the piston in at least one direction.

6. The gas-lift system of claim 5, wherein the first valve comprises:

a housing defining a first port and a second port, the first port being in communication with the annulus via an opening in the side-pocket mandrel, and the second port being in communication with the production tubing via a radial port in the side-pocket mandrel;

a valve seat; and a valve closure element that is movable with respect to the valve seat along with the piston, wherein, when the first valve is in the closed position, the valve closure element engages the valve seat and prevents fluid flow from the annulus into the production tubing via the first valve, and when the first valve is in the open position, the valve closure element is separated from the valve seat and permits fluid flow from the annulus into the production tubing via the first valve, wherein the pressure differential acts across the piston, and wherein the first value of the differential is sufficient to overcome a biasing force applied by the biasing member and to move the valve closure element toward or away from the valve seat.

7. The gas-lift system of claim 1, wherein the first valve comprises:

a housing defining a chamber therein, the chamber being in direct communication with the control line;

a valve element positioned in the housing;

a valve seat positioned in the housing; and a biasing member positioned in the chamber and configured to apply a biasing force on the valve element so as to bias the first valve toward the open position in which the valve element is separated from the valve seat or toward the closed position in which the valve element engages the valve seat, wherein the control line pressure is communicated directly to the chamber, outside of the biasing member, so as to compress the biasing member, and wherein the control line pressure reaching a first value overcomes the biasing force and causes the valve element to move with respect to the valve seat, whereby the valve element moving actuates the first valve.

8. The gas-lift system of claim 7, wherein the second valve also includes a biasing member, wherein the biasing member of the second valve applies a different biasing force than the biasing member of the first valve, such that the control line pressure reaching the first value does not cause or permit the second valve to actuate, and the control line pressure reaching a second value that is different from the first value causes the second valve to actuate.

9. A method for operating a gas-lift system, comprising:

injecting a gas into an annulus between a production tubing and a well, wherein the gas flows from the annulus into the production tubing through a first valve that is open;

closing the first valve by controlling a pressure in a control line that is coupled to the first valve, without causing or permitting a second valve that is subjacent to the first valve to close, wherein the pressure in the control line is independent of a pressure of the gas in the annulus;

increasing the pressure of the gas in the annulus after closing the first valve, such that the gas flows through the second valve and into the production tubing;

closing the second valve by controlling the pressure in the control line, which is also coupled to the second valve, independently of the pressure of the gas in the annulus and independently of a pressure in the production tubing, while maintaining the first valve in a closed position; and retrieving the first valve from within the well without removing the production tubing from the well.

10. The method of claim 9, wherein the first valve is positioned in a pocket of a side-pocket mandrel, and wherein retrieving the first valve comprises removing the first valve from the pocket through the production tubing.

11. The method of claim 10, wherein retrieving the first valve comprises removing the first valve from within a bore defined in the side-pocket mandrel, wherein the bore has an opening that communicates with the annulus and a radial port that communicates with the production tubing via a primary bore of the side-pocket mandrel, and wherein the control line extends axially through at least a portion of the side-pocket mandrel.

12. The method of claim 10, wherein retrieving the first valve comprises engaging an adaptive feature of the first valve using a wireline tool.

13. The method of claim 9, wherein closing the first valve comprises increasing the pressure in the control line such that a pressure differential generated at least partially by pressure in the control line overcomes a biasing force configured to bias the first valve to an open position.

14. The method of claim 9, wherein closing the first valve comprises reducing the pressure in the control line such that a pressure differential generated at least partially by the pressure in the control line does not overcome a biasing force configured to bias the first valve to a closed position.

15. The method of claim 9, further comprising opening the first and second valves by controlling the pressure in the control line such that a pressure differential generated at least partially by the pressure in the control line causes or permits the first and second valves to open.

16. The method of claim 9, wherein closing the first valve, closing the second valve, or both comprises changing a pressure in a second control line that is coupled to the first valve and the second valve to change a pressure differential in the first and second valves.

17. A gas-lift system, comprising:

a production tubing extending into a wellbore, wherein an annulus is defined radially between the production tubing and the wellbore;

a plurality of side-pocket mandrels coupled to the production tubing, each of the side-pocket mandrels defining a primary bore in communication with the production tubing, and a pocket that extends radially outward from an angular interval of the primary bore;

a plurality of gas-lift valves configured to selectively communicate the annulus with an interior of the production tubing, each of the plurality of gas-lift valves being received into the pocket of a respective one of the side-pocket mandrels;

a surface system comprising a pump configured to pump a hydraulic fluid; and a control line extending from the surface system to the plurality of gas-lift valves, the control line being configured to deliver the hydraulic fluid from the pump to the plurality of gas-lift valves to control opening and closing of the gas-lift valves independently of a pressure in the annulus and independently of a pressure in the production tubing.

18. The gas-lift system of claim 17, wherein each of the plurality of gas-lift valves comprises an adaptive feature configured to engage a wireline retrieval tool, such that the plurality of gas-lift valves are retrievable from within the wellbore.

19. The gas-lift system of claim 17, wherein each of the side-pocket mandrels comprises a bore having an axial opening and a radial port, and wherein the plurality of gas-lift valves each comprises:

a primary port in communication with the annulus via the axial opening;

an opening in communication with an interior of the production tubing via the radial port;

a bore in communication with the control line; and a valve element in communication with the control line via the bore and configured to be moved between an open position and a closed position, wherein the valve element in the closed position is configured to block communication between the primary port and the opening, and the valve element in the open position is configured to permit communication between the primary port and the opening.

20. The gas-lift system of claim 17, wherein the control line extends from a top surface and connects to the plurality of gas-lift valves in parallel.

* * * * *